US005442879A

United States Patent [19]

Christensen

[11] Patent Number: 5,442,879

[45] Date of Patent: Aug. 22, 1995

[54] COUNTERBALANCED WINDOW OPERATOR

[75] Inventor: Per B. Christensen, Puerto del Carmen, Spain

[73] Assignee: V. Kann Rasmussen Industri A/S, Soborg, Denmark

[21] Appl. No.: 76,125

[22] Filed: Jun. 14, 1993

[51] Int. Cl.[6] ..... E05F 1/10

[52] U.S. Cl. ..... 49/386; 49/343; 49/340

[58] Field of Search ..... 49/386, 339, 340, 341, 49/344, 345, 346, 324, 343

[56] References Cited

U.S. PATENT DOCUMENTS

| | | | |
|---|---|---|---|
| 1,938,502 | 12/1933 | Steindler et al. | 49/340 X |
| 2,698,173 | 12/1954 | Rydell . | |
| 2,767,979 | 10/1956 | Hummert . | |
| 2,779,069 | 1/1957 | Ziesmer | 49/386 X |
| 4,521,993 | 6/1985 | Tacheny et al. . | |
| 4,553,656 | 11/1985 | Lense | 49/140 X |
| 5,097,629 | 3/1992 | Guhl et al. . | |
| 5,179,803 | 1/1993 | Lense . | |

FOREIGN PATENT DOCUMENTS

| | | | |
|---|---|---|---|
| 236560 | 12/1961 | Australia | 49/343 |
| 186760 | 6/1907 | Germany . | |
| 824752 | 11/1951 | Germany . | |
| 9003179 | 7/1990 | Germany . | |
| 324587 | 11/1957 | Switzerland . | |
| 1132744 | 11/1968 | United Kingdom . | |

OTHER PUBLICATIONS

English translation of German Patent 186,670.
English translation of German Patent 824,752.
English translation of German Utility Model No. 90 03 179.2
English translation of Swiss Patent 324,587.

*Primary Examiner*—Jerry Redman
*Attorney, Agent, or Firm*—Lane, Aitken & McCann

[57] ABSTRACT

A counterbalanced window operator includes a housing in which a rotatable lead screw, rotated by a crank handle or electric power unit, cooperates with a non-rotatable nut member to axially displace the nut member and move pivoting arms to open and close the window.

20 Claims, 7 Drawing Sheets

COUNTERBALANCED WINDOW OPERATOR

BACKGROUND OF THE INVENTION

The present invention relates to an operator unit for opening and closing a window and, more particularly, to a counterbalanced window operator.

Operators are known for moving a window between closed and open positions, for example, a window having a stationary main frame mounted in a roof of a house or other building, especially a sloped roof, and a sash hinged to the main frame at the top of the sash for pivoting toward and away from the main frame. Such operators are typically mounted on a bottom member of the main frame and connected to a bottom member of the sash for pushing the sash away from the main frame and drawing the sash into engagement with the main frame. When the window operator is actuated to move the window in an opening direction, it must overcome a component of the weight of the window, especially when the window is mounted in a roof. In order to overcome this difficulty, counterbalancing devices employing springs have been provided to counteract the weight component of the window and, thereby, reduce the force which must be applied to the operator, either by hand or by a power unit. Counterbalanced window operators are disclosed in U.S. Pat. Nos. 5,097,629 to Guhl et al. and 2,698,173 to Rydell.

SUMMARY OF THE INVENTION

The construction according to the present invention offers the advantage that a very compact design of high stability and functional reliability is obtained so that, in the closed condition of the window, the moving means of the operating member between the sash and the main frame may be completely accommodated in a fairly small housing mounted on the bottom of the main frame.

DETAILED DESCRIPTION OF THE PREFERRED EMBODIMENTS

Figure 6:
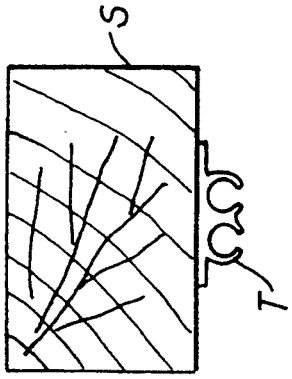
FIG. 6 is a cross section of a portion of a window sash to which the operator according to the present invention is connected.

Common features of the embodiments of the counterbalanced window operator according to the present invention which are shown in FIGS. 1–5, 7 and 8 are that a connection between a sash of a window and an operator housing 1, 11, 21, respectively, which is mounted, e.g., at a bottom member of the main frame of the window, is provided by two pivoting arms 2–3, 12–13, 22–23, respectively, one end of each of which is pivotally journaled about a pivot point in the housing 1, 11, 21. The other end of each pivoting arm is pivotally connected with a bottom member S of the sash by means of slide shoes **2*a*–3*a*, 12*a*–13*a*, 22*a*–23*a*, respectively, slidably displaceable in the longitudinal direction of that member in tracks of a track member T secured on the bottom member S, as can be seen from FIG. 6**.

Figure 8:
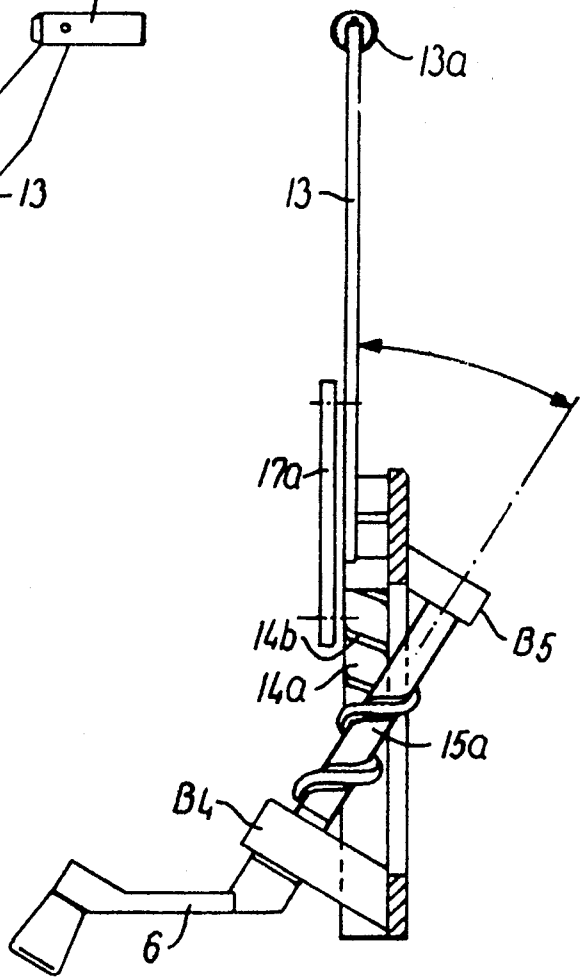
FIG. 8 is a right side view of the window operator of FIG. 7.
Figure 7:
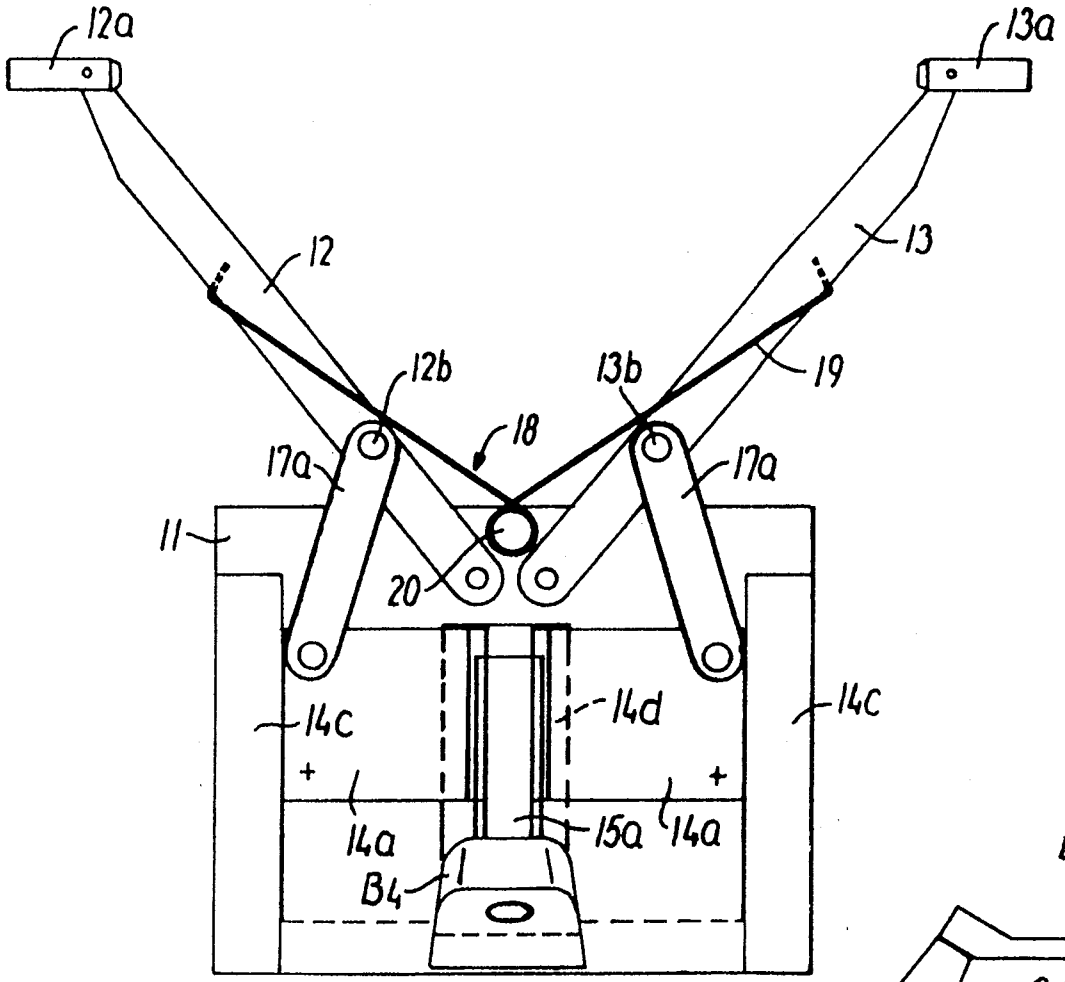
FIG. 7 is a schematic view of a sixth embodiment of a window operator according to the present invention.

The drive member for the opening movement is a non-rotatable nut member 4, 14, 24, respectively, engaged by the rotatable lead screw 5, 15, 25, respectively, operated by cranking the handle 6, 16, 26, respectively. A thrust bearing B1, B2, B3, respectively, is provided in the housing 1, 11, 21 to support the lead screw 5, 15, 25 for rotation and to withstand axial forces imposed on the lead screw. In the embodiment of FIGS. 7 and 8, thrust bearings B4 and B5 are used with a worm member **15*a***.

The connection between the nut member 4, 14, 24 and the pivotal arms 2–3, 12–13, 22–23 is provided by a symmetrical pair of links 7, 17, 27, respectively, having one end pivotally connected with the non-rotatable nut member 4, 14, 24 and another end pivotally connected with the respective arm 2–3, 12–13, 22–23 in a point **2*b*–3*b*, 12*b*–13*b*, 22*b*–23*b*, respectively, located at some distance from the end of the arm pivotally journaled in the housing 1, 11, 21. In the embodiment of FIGS. 7 and 8, a symmetrical pair of links 17*a* each has one end pivotally connected with a ratchet block 14*a* and another end connected with a respective arm 12–13 in a point 12*b*–13*b* located at some distance from the end of the arm pivotally journaled in the housing 11**.

In each illustrated embodiment, a symmetrical arrangement of a counterbalancing spring mechanism is provided to facilitate the opening movement of the window by compensating for the weight of the window.

Figure 1:
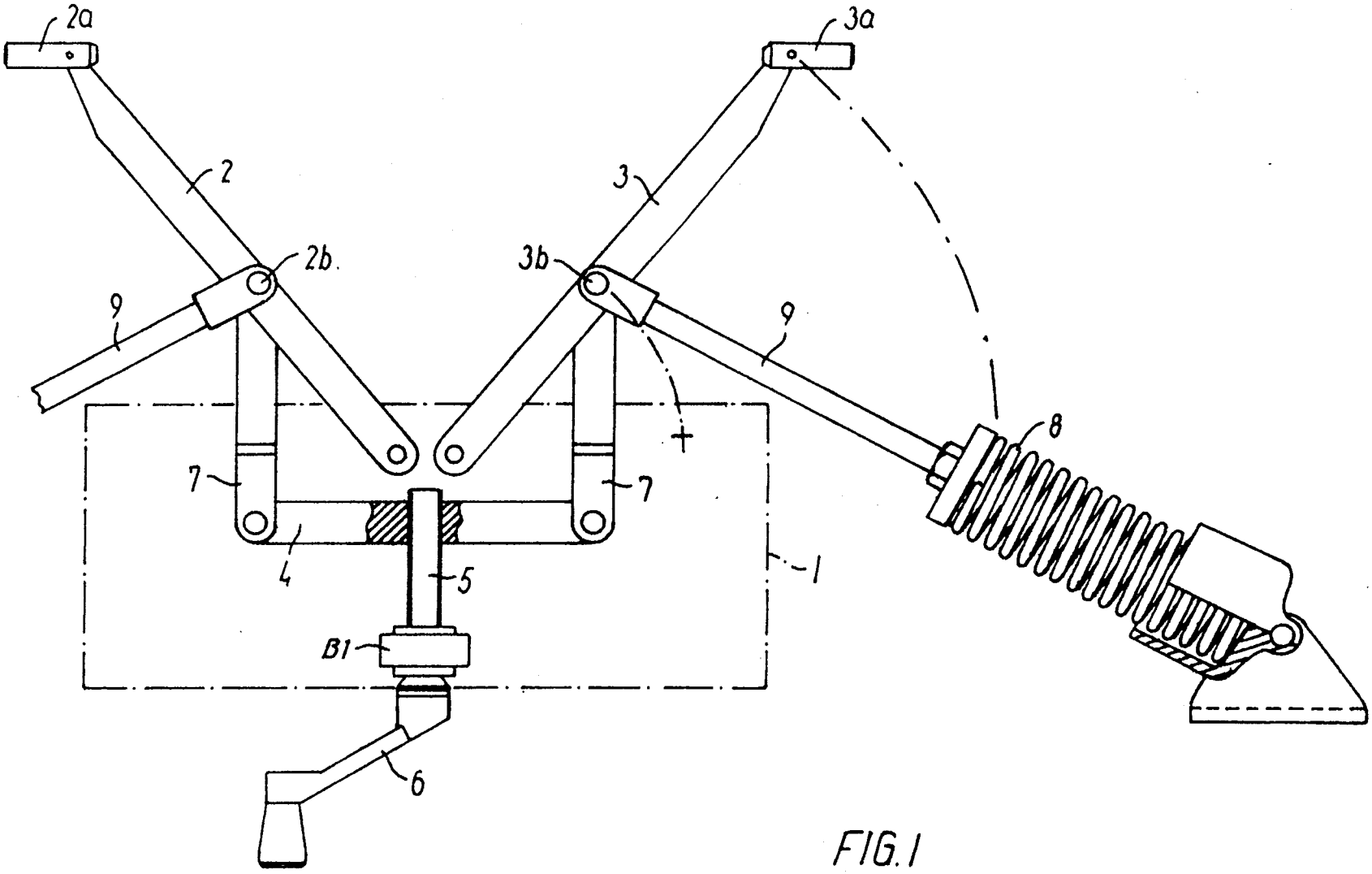
FIG. 1 is a schematic view of a first embodiment of a window operator according to the present invention.

In FIG. 1, the counterbalancing mechanism comprises on each side a compression spring 8, such as a coil spring, pivotally connected at one end to the bottom member of the main frame outside the housing 1 and pivotally connected at an opposite end to the above-mentioned respective point **2*b*–3*b* at the respective arm 2–3 through a rigid bar member 9. Although a compression spring 8 is shown only on the right side of FIG. 1, it is understood that a like spring is connected to the rigid bar 9 on the left side of FIG. 1. As an alternative, tension springs can be used in place of the compression springs 8**.

Figure 2:
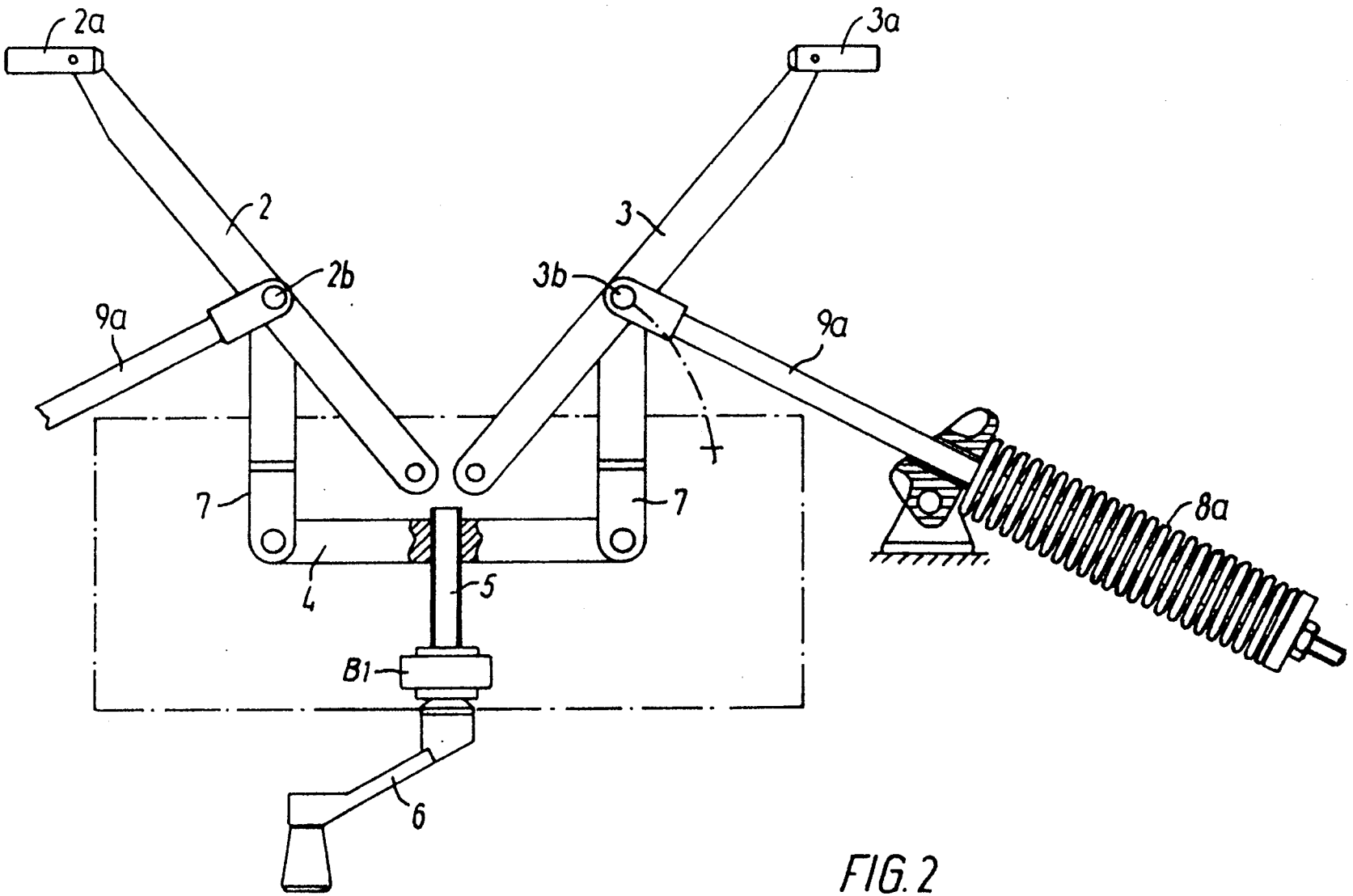
FIG. 2 is a schematic view of a second embodiment of a window operator according to the present invention.

In the embodiment of FIG. 2, a tension spring **8*a* has been substituted for the compression spring 8. A similar tension spring (not illustrated) is connected to the rigid bar 9*a* on the left side of FIG. 2. The bracket member connected with the main frame of the window is located at the end of the spring 8*a* adjacent to the pivot arm 3, whereas the rigid bar 9*a* is connected with the opposite end of the spring 8*a* distal to the pivot arm 3**.

Figure 3:
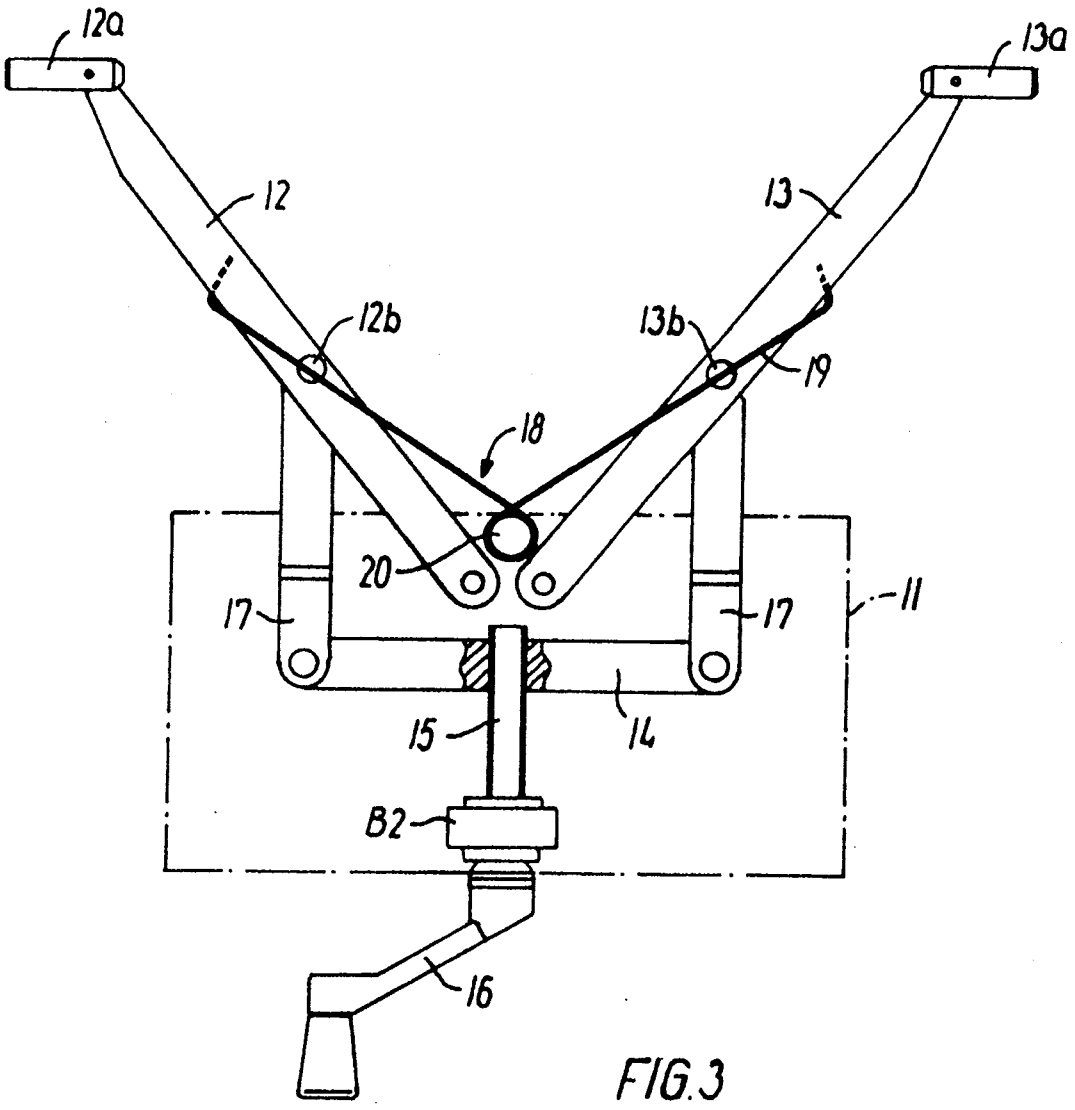
FIG. 3 is a schematic view of a third embodiment of a window operator according to the present invention.

In FIG. 3, the counterbalancing mechanism comprises a torsion spring 18 with two fingers 19 each curved around and engaging one of the pivoting arms 12–13, the torsion spring being mounted on a stationary pin 20 in the housing 11.

Figure 4:
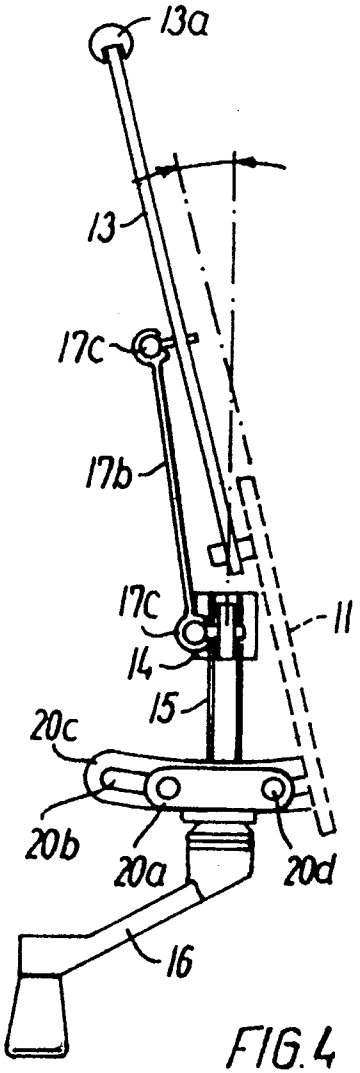
FIG. 4 is a side schematic view of a fourth embodiment of a window operator according to the present invention.

The embodiment of FIG. 4 is a modification of the embodiment of FIG. 3 in which links 17*b* between the non-rotatable nut member 14 and the arms 12, 13 allow the arms 12, 13 to pivot about an axis perpendicular to the axis of the rotatable lead screw 15. The connection between the links 17*b* and the pivot arms 12, 13, as well as between the links 17*b* and the non-rotatable nut member 14, comprise spherical joints, or ball-and-socket joints, 17*c* in the embodiment illustrated. Such joints permit the pivot arms 12, 13 to follow the opening movement of the bottom of the sash S as it pivots about the axis of the hinges at the top of the sash by which the sash is mounted on the main frame. The axis of the lead screw 15 is adjustable with respect to the main frame of the window by means of a slide member 20*a*, which is slidable in a curved slot 20*b* in a bracket 20*c* connected to the main frame and arrestable by means of arresting screws 20*d*.

Figure 5:
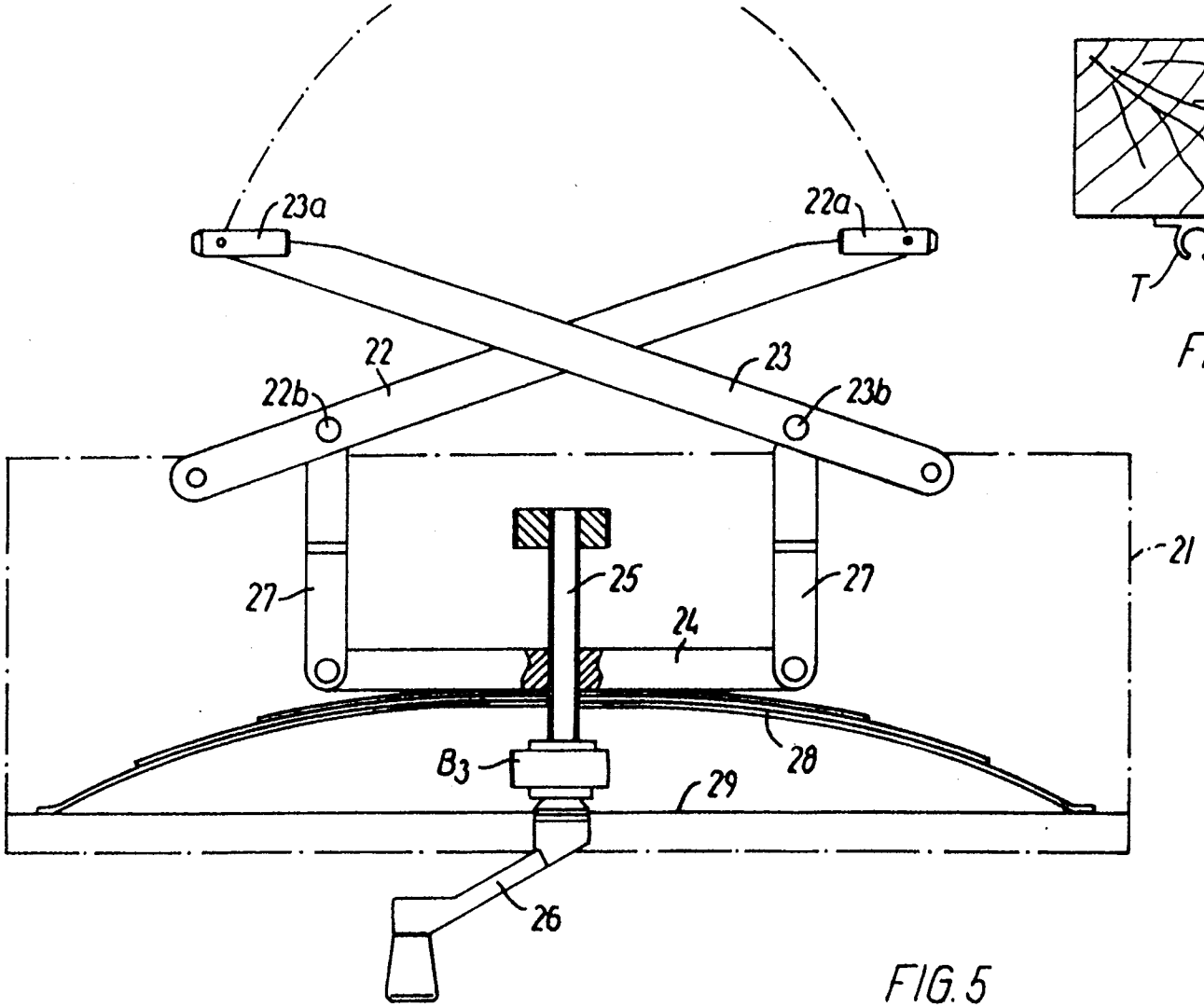
FIG. 5 is a schematic view of a fifth embodiment of a window operator according to the present invention.

In FIG. 5, the counterbalancing mechanism is provided by a laminated leaf spring 28 engaging and fixed at one wall 29 of the housing 21 and engaging the nut member 24.

As can be seen from FIGS. 7 and 8, which are views corresponding to the views of FIGS. 3 and 4, there is a different modification of the embodiment of FIGS. 3 and 4 by which the worm member 15*a* has been substituted for the threaded spindle or shaft 15 forming the screw member in FIG. 3. The non-rotatable nut member comprises in this case, not a head portion surrounding a threaded spindle, but rather two ratchet blocks 14*a* engaging the worm member 15*a* at diametrically opposite sides thereof. The ratchet blocks 14*a* are provided with tooth-like projections 14*b* engaging the worm member 15*a*. As can be seen in FIG. 8, this arrangement allows the axis of the screw member 15*a* to be inclined with respect to the ratchet blocks 14*a*, which are confined by guide members 14*c*, 14*d* to displacement in a plane parallel to the two arms 12, 13.

Figure 9:
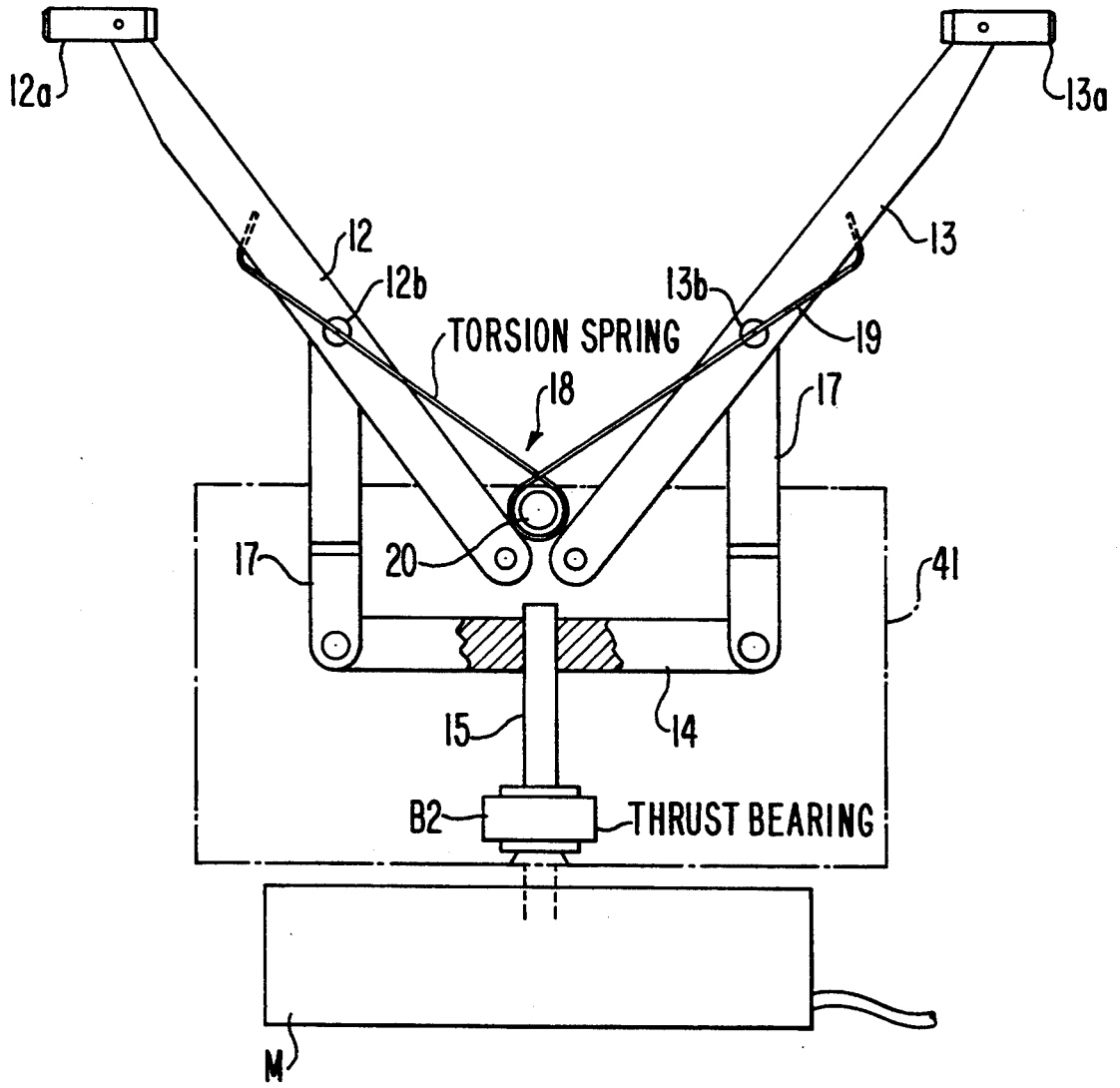
FIG. 9 is a schematic view of the window operator of FIG. 3 to which an electric drive unit, rather than a handle, is connected.

FIG. 9 shows an electric drive unit M connected to the lead screw 15 to drive the lead screw, instead of using the handle 16. The electric drive unit M can also be connected to the lead screws 5 and 25 of the other illustrated embodiments of the present invention rather than using the handles 6 and 26.

Figure 10:
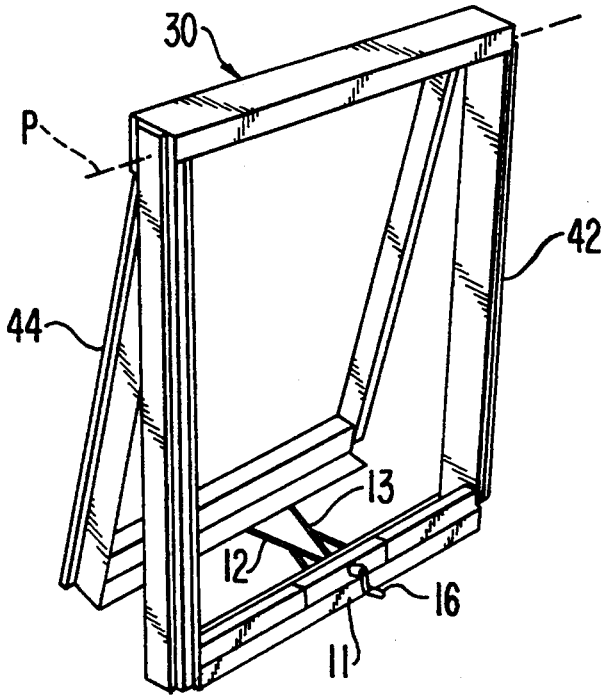
FIG. 10 is a schematic view of a window having a rectangular main frame and a rectangular sash mounted for pivoting movement relative to the main frame and employing the window operator according to the present invention.

As can be seen from FIG. 10, the operator according to the present invention is for opening a window 30 having a generally rectangular main frame 32 and a generally rectangular sash 34 mounted for pivoting movement relative to the main frame about a pivot axis P generally parallel to a pair of opposed sides of the sash.

It will be apparent to those skilled in the art and it is contemplated that variations and/or changes in the embodiments illustrated and described herein may be made without departure from the present invention. For example, although the non-rotatable member has been described as a non-rotatable nut member 4, 14, 24, other members having threaded openings can be employed, and still other changes may be made. Accordingly, it is intended that the foregoing description is illustrative only, not limiting, and that the true spirit and scope of the present invention will be determined by the appended claims.

I claim:

1. A window operator for opening and closing a window having a generally rectangular main frame and a generally rectangular sash mounted for pivoting movement relative to the main frame about a pivot axis generally parallel to a pair of opposed sides of said sash, comprising:

at least one unarticulated arm connected in a first end with one of said opposed sides of the sash and mounted for pivoting about a pivot point which is stationary with respect to said main frame, wherein said first end of said at least one arm is adapted for sliding connection with the sash of the window, whereas said pivot point is located at a second end of said arm;

moving means for moving said arm about the pivot point, said moving means comprising a rotatable elongate screw member journaled for rotation and having an axis which is arrestable with respect to said main frame, means for preventing axial displacement of said screw member with respect to said frame, and a non-rotatable nut member operatively connected with said arm and being engaged by said screw member to be axially displaced by said screw member upon rotation of said screw member, whereby to cause said arm to pivot about said pivot point; and counterbalancing means operatively connected between said main frame and said arm for counteracting a weight component of the window.

2. The window operator of claim 1, wherein said moving means further comprises a manually manipulatable member connected to said screw member for manual rotation of said screw member.

3. The window operator of claim 1, wherein said moving means further comprises an electrically powered drive unit connected to said screw member for rotating said screw member.

4. The window operator of claim 1, wherein said counterbalancing means comprises a coil spring having one end connected with said main frame and the other end connected to said arm at a point intermediate said first and second ends thereof.

5. The window operator of claim 4, wherein said coil spring is a compression spring.

6. The window operator of claim 4, wherein said coil spring is a tension spring.

7. The window operator of claim 1, comprising two of said arms.

8. The window operator of claim 1, wherein said counterbalancing means comprises a torsion spring secured about a stationary pin on said main frame, said torsion spring having a finger engaging said arm.

9. The window operator of claim 8, comprising two of said arms, wherein said torsion spring has two of said fingers, each of said fingers engaging a respective one of said arms.

10. The window operator of claim 1, further comprising a housing defined by at least one wall, said housing accommodating said moving means, wherein said counterbalancing means comprises a leaf spring interposed between and engaging said non-rotatable nut and a wall of said housing.

11. The window operator of claim 10, wherein said leaf spring is a laminated leaf spring.

12. The window operator of claim 11, wherein said leaf spring is fixed at one wall of said housing.

13. A window operator for opening and closing a window having a generally rectangular main frame and a generally rectangular sash mounted for pivoting movement relative to the main frame about a pivot axis generally parallel to a pair of opposed sides of said sash, comprising:

at least one arm connected in a first end with one of said opposed sides of the sash and mounted for pivoting about a pivot point which is stationary with respect to said main frame, wherein said first end of said at least one arm is adapted for sliding connection with the sash of the window, whereas said pivot point is located at a second end of said arm;

moving means for moving said arm about the pivot point, said moving means comprising a rotatable elongate screw member journaled for rotation and having an axis which is arrestable with respect to said main frame, means for preventing axial displacement of said screw member with respect to said frame, and a non-rotatable nut member operatively connected with said arm and being engaged by said screw member to be axially displaced by said screw member upon rotation of said screw member, whereby to cause said arm to pivot about said pivot point; and counterbalancing means operatively connected between said main frame and said arm for counteracting a weight component of the window, wherein said screw member comprises a threaded spindle and said nut member comprises a head member with a threaded bore engaged by said spindle, a link member connecting said head member to said arm at a point intermediate said first and second ends thereof.

14. The window operator of claim 13, comprising two of said arms, and a link member extending between said nut member and each of said arms.

15. The window operator of claim 13, wherein said link member comprises a first arm member rigidly connected with said head member and a second arm member, one end of which is linked for pivot connection with said first arm member, whereas the other end of said second arm member is linked for pivotal connection with said at least one arm.

16. The window operator of claim 15, wherein said second arm member is linked with said first arm member and said at least one arm by link means permitting movement of said at least one arm about a second axis generally perpendicular to the axis of said screw member.

17. The window operator of claim 16, wherein said link means comprises spherical joints at both ends of said second arm.

18. The window operator of claim 17, wherein the axis of said screw is adjustable with respect to said main frame in a plane perpendicular to said second axis.

19. A window operator for opening and closing a window having a generally rectangular main frame and a generally rectangular sash mounted for pivoting movement relative to the main frame about a pivot axis generally parallel to a pair of opposed sides of said sash, comprising:

two arms, each connected in a first end with one of said opposed sides of the sash and mounted for pivoting about a pivot point which is stationary with respect to said main frame, wherein said first ends of said arms are adapted for sliding connection with the sash of the window, whereas said pivot points are located at second ends of said arms;

moving means for moving said arms about the pivot points, said moving means comprising a rotatable elongate screw member journaled for rotation and having an axis which is arrestable with respect to said main frame, means for preventing axial displacement of said screw member with respect to said frame, and a non-rotatable nut member operatively connected with said arms and being engaged by said screw member to be axially displaced by said screw member upon rotation of said screw member, whereby to cause said arms to pivot about said pivot point; and counterbalancing means operatively connected between said main frame and said arms for counteracting a weight component of the window, wherein said screw member comprises a worm member and said nut member comprises two separate ratchet members having tooth-like projections engaging said worm member at diametrically opposed sides thereof, guide means being provided to confine displacement of said ratchet members in a plane parallel to said two arms, each ratchet member being operatively connected with a respective one of said two arms.

20. The window operator of claim 19, wherein the axis of said worm member is inclined with respect to said plane.

* * * * *